US005738601A

United States Patent [19]

Hughes

[11] Patent Number: 5,738,601

[45] Date of Patent: Apr. 14, 1998

[54] HEIGHT ADJUSTABLE BASKETBALL GOAL ASSEMBLY

[76] Inventor: Todd R. Hughes, 905 Crescent St., Scott City, Kans. 67871

[21] Appl. No.: 615,975

[22] Filed: Mar. 14, 1996

[51] Int. Cl.[6] ..... A63B 63/08

[52] U.S. Cl. ..... 473/484

[58] Field of Search ..... 273/1.5 R; 248/161, 248/162.1, 408, 409; 473/484

[56] References Cited

U.S. PATENT DOCUMENTS

| | | | |
|---|---|---|---|
| D. 343,883 | 2/1994 | Hall | D21/201 |
| D. 350,797 | 9/1994 | Curtis | D21/201 |
| 1,610,069 | 12/1926 | Weber | 248/408 X |
| 3,059,888 | 10/1962 | Lie | 248/161 |
| 3,443,784 | 5/1969 | Walkinshaw | 248/408 |
| 3,711,054 | 1/1973 | Bauer | 248/161 X |
| 4,035,096 | 7/1977 | Miller | 248/408 X |
| 4,415,135 | 11/1983 | French | 248/162.1 X |
| 4,801,142 | 1/1989 | Friesen | 473/484 |
| 5,133,547 | 7/1992 | Pardi | 273/1.5 R |
| 5,211,393 | 5/1993 | Rolffs et al. | 473/484 |
| 5,375,835 | 12/1994 | Van Nimwegen et al. | 273/1.5 R |
| 5,465,957 | 11/1995 | Schroeder | 273/1.5 R |
| 5,478,068 | 12/1995 | Schroeder | 273/1.5 R |

FOREIGN PATENT DOCUMENTS

| | | | |
|---|---|---|---|
| 586810 | 3/1994 | European Pat. Off. | 273/1.5 R |
| 21497 | 11/1894 | United Kingdom | 248/408 |

*Primary Examiner*—William H. Grieb

*Attorney, Agent, or Firm*—Hovey, Williams, Timmons & Collins

[57] ABSTRACT

A basketball goal apparatus has a basketball goal and an upright stand. The apparatus also includes a support assembly for supporting the goal on the stand at various heights spaced from the ground. The support assembly includes an elongated support member attached medially along the length thereof to the stand for swinging movement about a generally horizontal axis. The apparatus further includes a locking assembly for releasably locking the goal at the various heights, wherein the locking assembly includes a counterbalance body. The counterbalance body and basketball goal are pivotally connected to opposite ends of the support member such that raising and lowering of the counterbalance body swings the support member and thereby adjusts the height of the goal. The counterbalance body has a weight sufficient to substantially counterbalance the gravitational force of the basketball goal exerted on the support member. The locking assembly also includes a relatively stationary body and securing mechanism for releasably securing the counterbalance body to the stationary body to selectively prevent raising and lowering the counterbalance body.

13 Claims, 2 Drawing Sheets

HEIGHT ADJUSTABLE BASKETBALL GOAL ASSEMBLY

BACKGROUND OF THE INVENTION

1. Field of the Invention

The present invention relates generally to a height adjustable basketball goal assembly and, more particularly, to a locking assembly for releasably locking the goal at various heights, wherein the assembly includes a counterbalance body configured for counterbalancing the weight of the basketball goal so that height of the goal is adjusted virtually effortlessly.

2. Discussion of Prior Art

It is known to adjustably support a basketball goal on a support post so that the height of the goal may be varied for accommodating athletes of all sizes and ages. Moreover, basketball goal assemblies have been provided with means for assisting the user in adjusting the height of the basketball goal and maintaining the goal at the desired height. For example, basketball goal assemblies have been provided with a lift cable and winch for vertically shifting the basketball goal. Alternatively, traditional goal assemblies often employ hydraulic jacks or cylinders for adjustably positioning the goal at a desired height. Such conventional height adjustment means tend to be awkward, highly susceptible to wear and corrosion, expensive, and relatively complex.

In some instances, conventional basketball goal assemblies have been provided with a link swingably connected to the support post at a point spaced medially along the length of the link, in a "teeter-totter" fashion. The basketball goal is pivotally connected to one end of the link and a counterbalance weight is pivotally connected to the other end of the link so that the weight counterbalances the gravitational forces of the goal exerted on the link. In this respect, the height of the basketball goal may be adjusted by the user virtually effortlessly. However, such goal assemblies are problematic. First, in order for the weight to exert a sufficient force on the link to counterbalance the basketball goal, the weight is relatively large. Furthermore, in conventional goal assemblies, the weight is connected to the link a considerable distance from the support post and consequently is suspended a significant height above the ground. In this respect, the weight tends to be unsightly, unstable and potentially dangerous. Moreover, since conventional counterbalance weights merely serve to facilitate adjustment of the goal and do not secure the goal in the desired height, basketball goal assemblies employing this feature must also include structure for locking the goal in the desired position, which adds to the cost and complexity of the assembly and often detracts from the appearance of the assembly.

OBJECTS AND SUMMARY OF THE INVENTION

Responsive to the these problems, it is an object of the present invention to provide an improved height adjustable basketball goal assembly having structure for assisting the user in adjusting the height of the basketball goal and in maintaining the goal at the selected height. It is also an object of the present invention to provide such structure in a relatively simple and inexpensive design that is aesthetically pleasing and easy to operate. Another object of the present invention is to provide a counterbalance body for counterbalancing the basketball goal, thereby facilitating adjustment of the goal height. Yet another object of the present invention is to provide a counterbalance body which forms part of the locking assembly for releasably maintaining the basketball goal at the desired height so that the counterbalance body serves a dual function, thereby reducing the complexity of the goal assembly and essentially "disguising" the counterbalance body as a component of the locking assembly rather than an unwieldy and unsightly weight.

In accordance with these and other objects evident from the following description of a preferred embodiment of the invention, the basketball goal apparatus includes a locking assembly for releasably locking a basketball goal at various heights, wherein the locking assembly includes a counterbalance body having a weight sufficient to substantially counterbalance the basketball goal.

Particularly, the apparatus includes a generally upright stand and a support assembly for supporting the basketball goal on the stand at various heights spaced from the ground. The support assembly includes an elongated support member attached medially along the length thereof to the stand for swinging movement about a generally horizontal axis. The counterbalance body and basketball goal are pivotally connected to opposite ends of the support member such that raising and lowering of the counterbalance body swings the support member and thereby adjusts the height of the goal. The locking assembly further includes a stationary body and securing mechanism for releasably securing the counterbalance body to the stationary body to selectively prevent raising and lowering of the counterbalance body.

Preferably, the counterbalance and stationary bodies are elongated, with the counterbalance body being tubular for telescopically receiving the stationary body therein such that extension and retraction of the counterbalance body relative to the stationary body swings the support member and thereby adjusts the height of the goal. If desired, a plurality of friction-reducing spacers are secured between the bodies for preventing contact therebetween.

The preferred stationary body includes a plurality of longitudinally spaced openings, while the counterbalance body has a hole which is selectively aligned with the openings as the counterbalance body is raised and lowered. The preferred securing mechanism includes a pin configured for removable reception within the hole and a selected opening. The pin is coupled with the counterbalance body in alignment with the hole and is yieldably biased inwardly through the hole and toward the stationary body. A tubular housing may be provided, with the inboard end of the housing fastened to the counterbalance body and the outwardly tapering outboard end slidably receiving the pin. The pin is preferably provided with a peripheral rib which cooperates with the outboard end of the sleeve to retain a compression spring therebetween. The securing mechanism also includes a pivotal, elongated handle connected to the pin and extending along the length of the counterbalance body for facilitating manual shifting of the pin against the bias.

BRIEF DESCRIPTION OF THE DRAWING FIGURES

A preferred embodiment of the invention is described in detail below with reference to the attached drawing figures, wherein.

Figure 5:
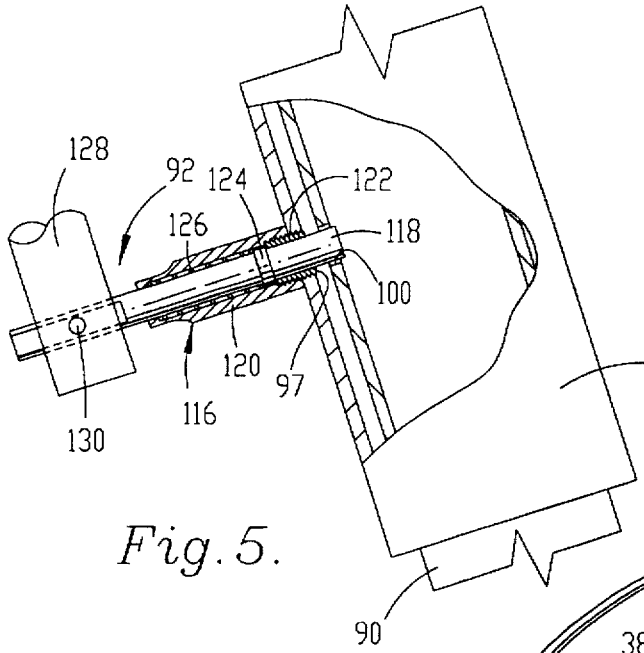
Figure 6:
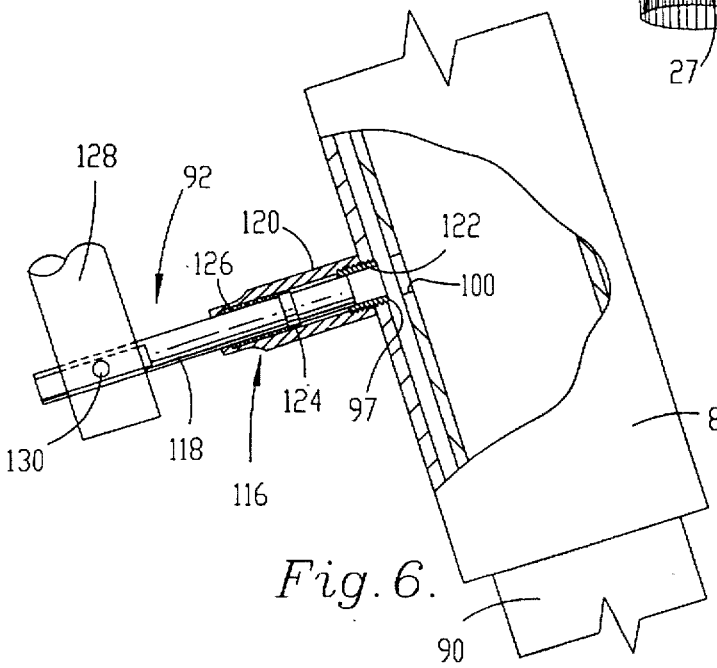

FIG. 5 is an enlarged fragmentary, side elevational view of a portion of the locking assembly, with portions of the counterbalance tube and spring-pin assembly being broken away to show the locking pin in a locked position, in which extension and retraction of the counterbalance tube relative to the guide rail is prevented; and FIG. 6 is an enlarged fragmentary, side elevational view similar to FIG. 5, but illustrating the locking pin in a release position, in which extension and retraction of the counterbalance tube relative to the guide rail is allowed.

DETAILED DESCRIPTION OF THE PREFERRED EMBODIMENT

Figures 1, 3, 4:
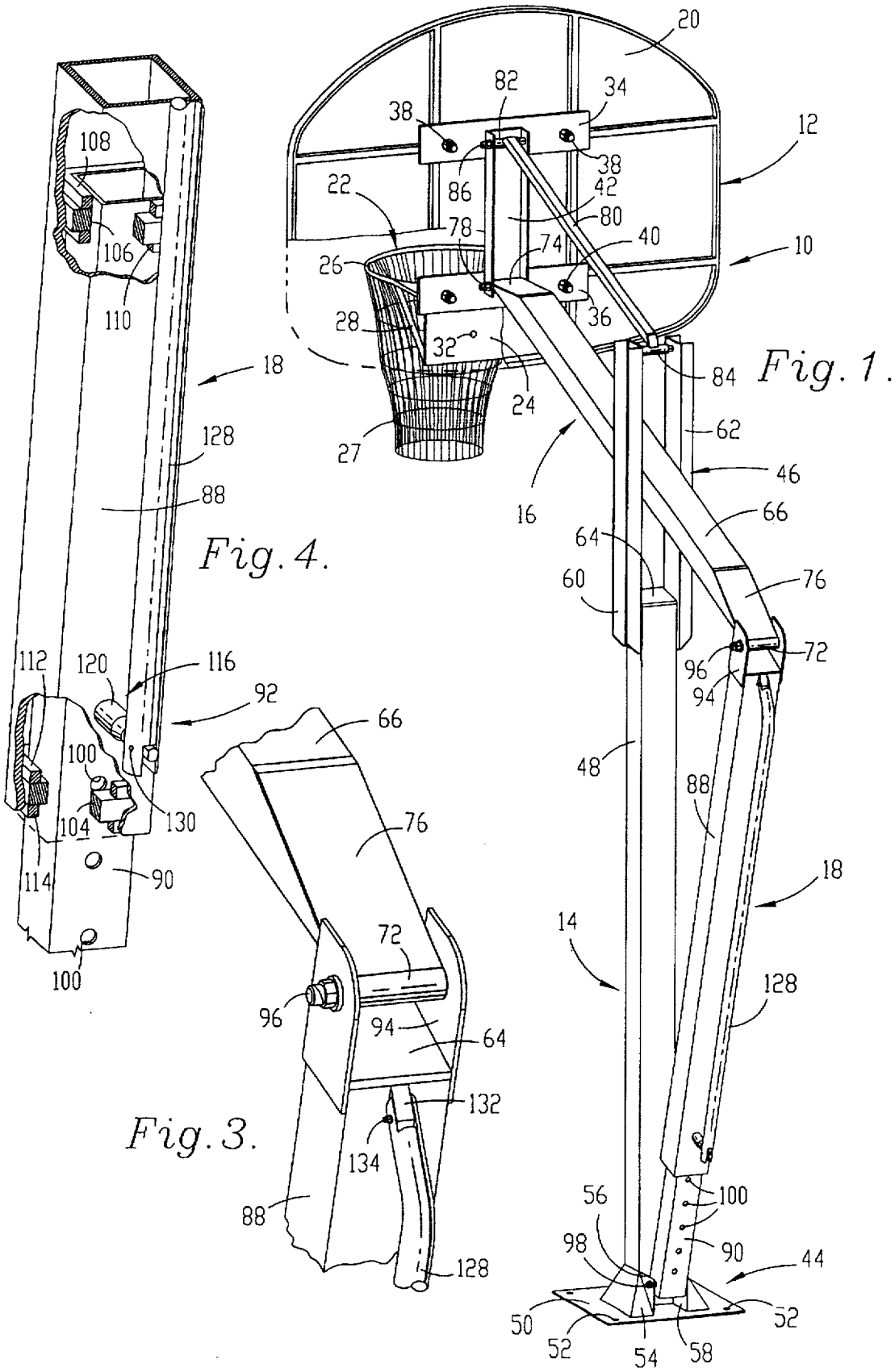
FIG. 1 is a perspective view of a basketball goal apparatus constructed in accordance with the preferred embodiment of the present invention, illustrating the various components of the apparatus in respective positions corresponding to the raised basketball goal.
FIG. 3 is an enlarged fragmentary, perspective view of the upper end of the counterbalance tube, particularly illustrating the pivotal connection between the counterbalance tube and the support member and the pivotal connection between the counterbalance tube and the handle.
FIG. 4 is an enlarged fragmentary, perspective view of a portion of the locking assembly, with portions of the counterbalance tube being broken away to show the plastic spacers interposed between the counterbalance tube and the internal guide rail, and particularly illustrating the pivotal connection between the pin and the handle of the securing mechanism.

Turning initially to FIG. 1, the preferred embodiment contemplates a basketball goal apparatus 10 generally including a basketball goal 12, a generally upright stand 14, a support assembly 16 for supporting the goal 12 on the stand 14 at various heights spaced from the ground, and a locking assembly 18 for releasably locking the goal 12 at the various heights.

The construction of the basketball goal 12 is well known in the art and may vary as desired. Accordingly, it is sufficient to explain that the goal 12 generally includes a backboard 20 formed of wood, fiberglass or some other suitable material and a metal hoop 22 attached to the from side backboard 20. The hoop 22 has a generally L-shaped bracket 24 connected to a substantially circular rim 26, from which a net is suspended, and a pair of angled braces 28 (only one being illustrated in FIG. 1) extending between the bracket 24 and rim 26 for assisting in supporting the rim 26 in the desired orientation. The hoop 22 is attached to the backboard 20 by a pair of bolt assemblies 30 which are received within laterally spaced openings 32 defined in the bracket 24 (only one being illustrated in FIG. 1) and corresponding openings (not shown) defined in the backboard.

A pair of vertically spaced connecting plates 34 and 36 are fastened to the rear side of the backboard by respective bolt assemblies 38 and 40, or other suitable means. It will be appreciated that the heads of the bolt assemblies 38 and 40 are countersunk into the front side of the backboard 20 so as to minimize interference with use of the basketball goal 12. A mounting member 42, which in the illustrated embodiment takes the form a U-shaped channel having a pair of laterally spaced sidewalls, is connected between the mounting plates 34,36 by suitable means, such as welding. As will hereinafter be described, the mounting member 42 serves to connect the basketball goal 12 to the support assembly 16. In the preferred embodiment, the connecting plates 34,36 and mounting member 42 are formed of metal, although other material such as fiberglass may be employed.

Figure 2:
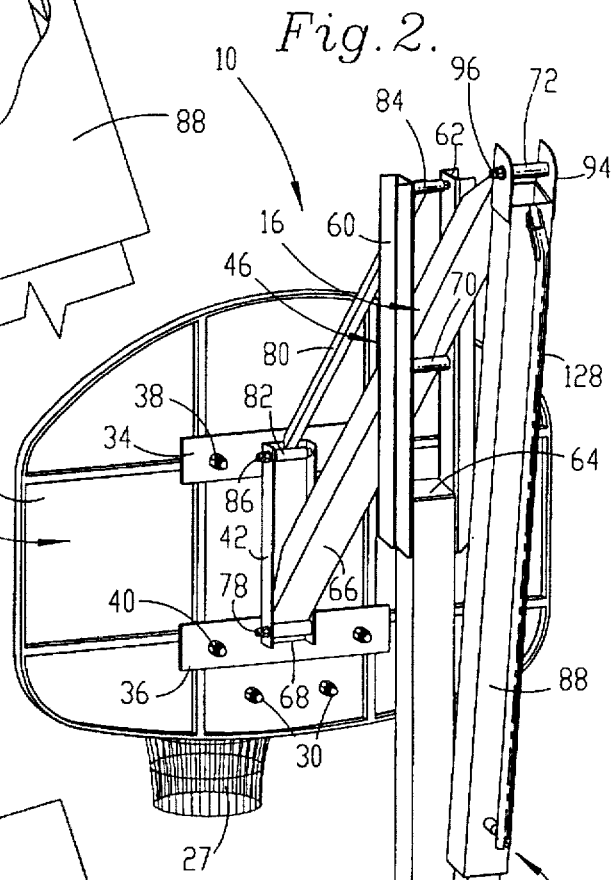
FIG. 2 is a perspective view similar to FIG. 1, but illustrating the basketball goal in a relatively lower position.

The preferred stand 14 is formed of metal and generally comprises a lower base portion 44, a yoke portion 46 to which the support assembly 16 is pivotally attached, and a post portion 48 extending therebetween (FIGS. 1 and 2). Although the illustrated stand 14 is designed to be anchored to a basketball court (not shown) or to a surface substantially level thereto, it will be appreciated that the principles of the present invention are equally applicable to a stand which is mounted to a generally vertical structure, such as a gymnasium wall.

With the foregoing caveat in mind, the preferred base portion 44 includes a rectangular anchor plate 50 having a plurality of holes 52 which are configured for receiving anchor bolts for securing the stand 14 to as surface. It will be appreciated that the anchor plate 50 may be anchored to the ground, a gymnasium floor, a wheeled carriage for enhancing portability of the apparatus 10, or any other desired structure. Extending obliquely from the anchor plate 50 are plurality reinforcing gussets 54 which are preferably welded to the anchor plate and 50 and post portion 48 for supporting the latter in a generally upright orientation. Preferably, the gussets 54 are arranged substantially about the entire perimeter of the post portion 48, except for a section along the rear side of the post portion that has a pair of vertical coupling plates 56,58, the purposes of which will subsequently be described. In a similar manner, the coupling plates 56,58 are also welded to the anchor plate 50 and post portion 48.

The upper yoke portion 46 consists of a pair of upright extension flanges 60 and 62, which are formed of U-shaped channels in the illustrated embodiment. The flanges 60,62 are preferably welded to opposite sides of the post portion 48 to define a space therebetween, in which the support assembly 16 is disposed.

The preferred post portion 48 is formed of an elongated, square-shaped tube which is supported in an upright orientation by the anchor plate 50 and gussets 54, as previously described. Preferably, a cap 64 is provided for covering the top of the tube so as to prevent rain water and debris from collecting within the post portion.

Turning to the support assembly 16, a cantilever support link 66 is provided for interconnecting the basketball goal 12 with the locking assembly 18. The cantilever link 66 is preferably formed of square-shaped tubing and has a front tubular sleeve 68, a medial tubular sleeve 70 and a rear tubular sleeve 72 fixedly connected to the bottom side thereof. As best shown in FIG. 1, a pair of capping plates 74,76 are provided at the ends of the cantilever link 66 for preventing trash and water accumulation therein. A bolt assembly (not shown) fastened to the flanges 60,62 of the yoke portion 46 is also slidably received within the medial sleeve 70 for attaching the cantilever link 66 to the stand 14 for swinging movement about a substantially horizontal axis (such axis being defined by the bolt assembly). Likewise, a bolt assembly 78 is slidably received within the front sleeve 68 and corresponding openings (not shown) defined in the sidewalls of the mounting member 42 for pivotally connecting the cantilever link 66 to the basketball goal 12. In this respect, the link 66 serves as a cantilever for the basketball goal 12. As will be described below, the rear sleeve 72 is similarly connected with the locking assembly 18.

The support assembly also includes a relatively smaller brace link 80 having a pair of front and rear sleeves 82 and 84, respectively. The sleeves 82,84 receive bolt assemblies 86 (only the front bolt assembly being illustrated) for swingably connecting the brace link 80 between the yoke portion of the stand 14 and the backboard 20. It will be appreciated that the cantilever link 66 and brace link 80 cooperate with the yoke portion 46 of the stand 14 and the mounting member 42 to define a parallel four bar linkage which maintains the vertical disposition of the backboard 20 as the goal 12 is adjusted to various heights. If desired, the sleeves of the cantilever link 66 and brace link 80 may be provided with internal bushings formed of a suitable material, such as brass or plastic, for reducing friction between the metal sleeves and respective bolt assemblies.

As shown in FIGS. 1 and 2, the locking assembly 18 generally includes a pair of telescopically interfitted bodies, including an elongated, hollow counterbalance tube 88 and an elongated, internal guide rail 90 received within the tube 88. The preferred locking assembly 18 also includes a securing mechanism 92 for releasably securing the counterbalance tube 88 to the guide rail 90 to selectively prevent raising and lowering of the counterbalance tube 88.

As shown in FIG. 3, the counterbalance tube 88 includes a clevis bracket 94 adjacent the upper end thereof configured for pivotal connection with the cantilever link 66. Particularly, a bolt assembly 96 is received within the rear sleeve 72 of the cantilever link 66 and corresponding holes (not shown) defined within the bracket 94. In this respect, raising and lowering of the counterbalance tube 88 swings the cantilever link 66 and thereby adjusts the height of the basketball goal 12. In other words, extension and retraction of the counterbalance tube 88 relative to the guide rail 90 serves to adjust the height of the basketball goal 12. The counterbalance tube 88 further includes a hole 97 defined within the lower, rear side thereof, the purposes of which will be described below. It will be appreciated that the counterbalance tube 88 is formed of square tubing having a weight sufficient to substantially counterbalance the gravitational force of the basketball goal 12 exerted on the forward end of the cantilever link 66. Accordingly, the height of the basketball goal 12 may be adjusted virtually effortlessly by raising and lowering the counterbalance tube 88.

The internal guide rail 90, on the other hand, is pivotally connected adjacent its lower end to the base portion 44 of the stand 14 by a bolt assembly 98. The internal guide rail 90 is preferably formed of square-shaped tubing configured for reception within the counterbalance tube 88. A plurality of longitudinally spaced openings 100 are defined within the rear side of the guide rail 90. As will be described below, the openings 100 are selectively aligned with the hole 97 of the counterbalance tube 88, whereby each opening corresponds with an adjusted height of the basketball goal 12. It will be appreciated that the guide rail 90 assists in limiting the movement of the counterbalance tube 88 generally to the aforementioned extension and retraction so that the tube does not dangle freely from the cantilever link 66.

Turning to FIG. 4, a pair of upper and lower friction-reducing spacers 104 and 106, respectively, are disposed between the counterbalance tube 88 and guide rail 90. The spacers 104, 106 are configured for slidably engaging the interior surface of the counterbalance tube 88 and the exterior surface of the guide rail 90. The spacers 104,106 extend perimetrically about the guide rail 90 for preventing contact between the counterbalance tube 88 and guide rail 90. Preferably, the spacers have a generally rectangular cross-section and are formed of a plastic material such as Ultra-High-Molecular-Weight polyethylene, although other suitable materials may be utilized. In the illustrated embodiment, the upper spacer 104 is secured in the position illustrated in FIG. 4 by rectangular retainers 108 and 110, which are attached to the internal guide rail 90 by suitable means such as mechanical fasteners or welding. In a similar manner, the lower spacer 106 is secured in the position illustrated in FIG. 4 by rectangular retainers 112 and 114.

As previously indicated, the securing mechanism 92 serves to selectively prevent relative movement between the counterbalance 88 and guide rail 90. Specifically, the securing mechanism 92 includes a spring-pin assembly 116 which is generally coaxial with the hole 97 of the counterbalance tube 88. As shown in FIGS. 5 and 6, the spring-pin assembly 116 generally includes a cylindrical locking pin 118 and a substantially cylindrical, tubular housing 120 which encircles the pin 118. An externally threaded nipple 122 is threadably received within the inboard end of the cylindrical housing 120 and the hole 97 for releasably attaching the housing to the counterbalance tube 88. On the other hand, the outboard end of the cylindrical housing 120 tapers outwardly for slidably receiving the locking pin 118 therein. In the illustrated embodiment, the locking pin has a circumferential rib 124 spaced inwardly from the outboard end of the housing 120, wherein the rib 124 cooperates with the outboard end of the housing 120 to retain a compression spring 126 therebetween.

The compression spring 126 serves to yieldably bias the locking pin 118 inwardly toward a locking position (illustrated in FIG. 5), in which the pin projects through the hole 97 and one of the openings 100 for preventing relative movement between the counterbalance tube 88 and guide rail 90. The threaded nipple 122 functions as a stop against which the circumferential rib 124 abuttingly engages when the pin 118 is in the locking position for limiting inward travel of the pin. It will be appreciated that the nipple 122 may be adjusted by the user for varying the amount of travel of the locking pin 118. Of course, the locking pin 118 may be shifted outwardly against the bias of the spring 126 to a release position (illustrated in FIG. 6), in which the pin is removed from the aligned opening 100 and the hole 97 to allow extension and retraction of the counterbalance tube 88 relative to the guide rail 90.

To assist in shifting the locking pin 118 toward the release position, an elongated handle 128 is pivotally connected to the outboard end of the pin. As best shown in FIGS. 5 and 6, a dowel 130 is received within corresponding openings (not shown) defined within the locking pin 118 and lower end of the handle 128 for pivotally interconnecting the pin and handle. Similarly, the upper end of the handle 128 is pivotally connected to an ear 132 depending from the counterbalance tube 88 by a bolt assembly 134. The handle is substantially coextensive with the counterbalance tube 88 for facilitating gripping of the handle as the same is raised and lowered with the counterbalance tube 88. Accordingly, when the handle 128 is manually pulled outwardly (generally leftwardly viewing FIGS. 5 and 6), the handle pivots about the bolt assembly 134 which in turn shifts the locking pin 118 outwardly against the bias of the spring 126. Furthermore, once the handle 128 is released, the bias of spring 126 shifts the locking pin 118 and handle 128 inwardly toward the locking position (in a generally rightward direction viewing FIGS. 5 and 6).

In use, the basketball goal apparatus is anchored to a suitable surface as previously described. When it is desired to adjust the height of the basketball goal 12, the user pulls the handle 128 outwardly, which in turn shifts the locking pin 118 to the release position illustrated in FIG. 6. The user may then extend or retract (i.e., raise or lower) the counterbalance tube 88 relative to the guide rail 90 for adjusting the height of the basketball goal 12. Again, such adjustment is made virtually effortless because of the counterbalancing relationship between the basketball goal 12 and counterbalance tube 88. Once the goal has been moved to the desired height, the handle 128 is released which allows the spring 126 to shift the locking pin 118 into the locking position. If desired, indicia may be placed on the rear side of the guide rail 90 for indicating the height of the basketball goal corresponding with each opening 100.

Although the invention has been described with reference to the preferred embodiment illustrated in the attached drawing figures, it is understood that substitutions may be made and equivalents employed herein without departing from the scope of the invention as recited in the claims. For example, the illustrated spring pin assembly 116 may be eliminated so that the securing mechanism simply includes a pin removably inserted into the hole 97 of the counterbalance tube 88 and a selected opening 100 of the guide rail 100.

Further, the inventor hereby states his intent to rely on the Doctrine of Equivalents to determine and assess the reasonably fair scope of the invention as pertains to any apparatus not materially departing from but outside the literal scope of the invention as set out in the following claims.

What is claimed is:

1. A basketball goal apparatus comprising:

a basketball goal including a backboard and a hoop attached to the backboard;

a generally upright stand;

a support assembly for supporting the goal on the stand at various adjusted heights spaced from the ground, said support assembly including an elongated support member attached medially along the length thereof to the stand for swinging movement about a generally horizontal axis;

a locking assembly for releasably locking the goal at the various adjusted heights, wherein said locking assembly includes an extendable and retractable link connected between the stand and the support member and having a pair of relatively shiftable portions for adjusting the length of the link, said link and the basketball goal being pivotally connected to the support member adjacent opposite ends thereof such that extension and retraction of the link swings the support member and thereby adjusts the height of the goal, said link including a shiftable counterbalance portion moveable with the support member, and a guide portion pivotally anchored at one end to the stand and shiftably coupled at an opposite end with the counterbalance portion, said counterbalance portion being of sufficient weight to substantially counterbalance the gravitation force of the basketball goal exerted on the support member, and mechanism for selectively preventing extension and retraction of the link for maintaining the adjusted height of the basketball goal.

2. A basketball goal apparatus as claimed in claim 1, said stand including a lower base portion to be anchored to the ground, an upper yoke portion having a pair of laterally spaced brackets to which the support assembly is attached, and a post portion extending between the base and yoke portions.

3. A basketball goal apparatus as claimed in claim 1, said support assembly including a four-bar linkage for maintaining the backboard in a generally vertical position as the height of the basketball goal is adjusted, said support member being one of the bars, and a second brace member swingably connected between the stand and the backboard being another one of the bars.

4. A basketball goal apparatus as claimed in claim 1, one of said portions of the link having an elongated, tubular construction, with the other portion being telescopically received therein.

5. A basketball goal apparatus as claimed in claim 4, said locking assembly including a plurality of friction-reducing spacers disposed between the counterbalance portion and the guide portion so that contact between the two portions is prevented.

6. A basketball goal apparatus as claimed in claim 4, said counterbalance portion having an elongated, tubular construction, with the guide portion being telescopically received within the shiftable portion.

7. A basketball goal apparatus as claimed in claim 6, said guide portion having a plurality of longitudinally spaced openings, said portion having a hole which is selectively aligned with the openings of the guide portion, whereby each of said openings corresponds with an adjusted height of the basketball goal, said mechanism including a pin configured for removable reception within the hole and a selected opening.

8. A basketball goal apparatus as claimed in claim 7, said pin being counterbalance coupled with the shiftable portion in alignment with said hole, said pin being yieldably biased inwardly through the hole and toward the guide portion such that the pin is biased into one of the openings once the pin is aligned with said one opening.

9. A basketball goal apparatus as claimed in claim 8, said mechanism including a tubular sleeve having an inboard end fastened to the counterbalance portion and an outwardly tapering outboard end slidably receiving the pin, said pin including a peripheral rib spaced inwardly from the outboard end of the sleeve, said mechanism further including a compression spring disposed between the outboard end of the sleeve and the peripheral rib of the pin.

10. A basketball goal apparatus as claimed in claim 8, said mechanism including an elongated handle extending along the length of the counterbalance portion, said handle being pivotally connected between the pin and the shiftable portion for facilitating manual shifting the pin against the bias.

11. A basketball goal apparatus as claimed in claim 4, said counterbalance portion and said guide portion being substantially coextensive when the basketball goal is in its highest position.

12. A basketball goal apparatus as claimed in claim 1, said mechanism being carried by said counterbalance portion.

13. A basketball goal apparatus as claimed in claim 12, said mechanism including an elongated handle for allowing manual control thereof, said handle being swingably carried by said counterbalance portion.

* * * * *